United States Patent [19]

Von Knorring

[11] 4,262,729

[45] Apr. 21, 1981

[54] ROLLER BLINDS

[76] Inventor: Enar S. Von Knorring, 77020 Söderbarke, Sweden

[21] Appl. No.: 31,088

[22] Filed: Apr. 18, 1979

Related U.S. Application Data

[63] Continuation-in-part of Ser. No. 858,212, Dec. 7, 1977, abandoned.

[51] Int. Cl.[3] ..... E06B 9/20; A47H 1/00

[52] U.S. Cl. ..... 160/242; 160/319

[58] Field of Search ..... 160/242, 319, 323–326, 160/310, 66, 68

[56] References Cited

U.S. PATENT DOCUMENTS

| | | | |
|---|---|---|---|
| 1,595,234 | 8/1926 | Kuyper | 160/242 |
| 1,809,779 | 6/1931 | Fromont | 160/319 |
| 3,779,302 | 12/1973 | Akers et al. | 160/68 |
| 3,934,832 | 1/1976 | Zilver | 160/319 |

FOREIGN PATENT DOCUMENTS

| | | | |
|---|---|---|---|
| 1600 | of 1877 | United Kingdom | 160/319 |

*Primary Examiner*—Peter M. Caun

*Attorney, Agent, or Firm*—William A. Drucker

[57] ABSTRACT

A roller blind has a roller with axially projecting trunnions each of which engages in an elongated slot in a respective end bracket mounting the blind on a supporting structure such as a window frame. One trunnion carries a keyed pulley upon which to wind a cord for operating the blind. To guide the cord there is provided a sleeve which surrounds the pulley in freely relatively rotatable manner and which has a radial opening through which the cord is fed onto, and from, the pulley. The improvement is that the sleeve is enabled to follow movement of the roller and pulley towards and away from the supporting structure but nevertheless remain secured against rotation. In a preferred form, the sleeve is secured for such purpose by a sheath, for the cord, attached at one end to the sleeve and at the other end to the supporting structure.

5 Claims, 5 Drawing Figures

ROLLER BLINDS

This is a continuation in part of application Ser. No. 858,212, filed 12/07/77, now abandoned.

BACKGROUND OF THE INVENTION

This invention relates to a roller blind which has axially projecting trunnions guided in slots in brackets to enable said roller to be rotated and also to be displaced towards and away from a window upon rotation of said roller, thereby enabling the screen to be located as close to the window as possible when the screen is in its unrolled position of use.

The object of the invention is to provide a simple and reliable cord drive means for said roller. Further objects will be apparent from the following description, the drawing and the claims.

BRIEF DESCRIPTION OF THE DRAWING

The drawing illustrates a preferred embodiment of the invention.

In the drawing.

DESCRIPTION OF THE PREFERRED EMBODIMENT

Figure 2:
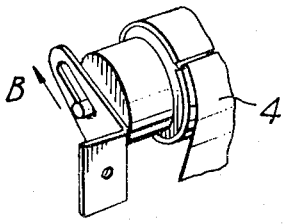
FIG. 2 is a perspective view showing part of the roller blind in a condition wherein the screen is unrolled.

The roller blind comprises a roller 1 in the form of a tube 2, having a longitudinal slot 3 which permits a simple connection of the screen 4 (FIG. 2). Said screen has at one end thereof a hem in which is housed an element made preferably of resiliently compressible material and dimensioned so as to be capable of being pressed into said tube 2 through said slot 3. The roller 1 need not be a tube but may be solid. It may also be a tube made from a planar sheet material formed to a roller in a rolling operation. At the opposite end of said screen there is provided a hem which receives a curtain rod 5, (see FIG. 3).

An end piece 6 has a cylindrical portion 7 which is securely pressed into one end of the tube and end piece, and a flange 8. Extending axially from said flange is a trunnion which has a square portion 9 which continued in a cylindrical end portion 10.

Mounted to rotate with said square portion 9 is a flanged roller 11 which has a square central opening 12 to cooperate with said square portion 9.

A cord 13 is secured at one of its ends to said flanged roller 11 by passing the cord through a hole 14 and then tying a knot 16 in the cord. The knot seats into a recess 15. The cord is wound around the middle portion of the roller 11 so as to be fully wound up when the screen is completely rolled out from the roller, and vice versa.

Rotatably mounted with respect to the flanged roller 11, is a sleeve 17, and an annular space is thus bounded between the internal periphery 18 of the sleeve and the middle portion of roller 11. The axial dimension of said flanged roller 11, exceeds the axial dimension of said sleeve just sufficiently to permit free relative movement of the sleeve with respect to the roller 11 and flange 8 when the roller 11 is abutting the bracket 23. Sleeve 17 has a radial projection 19 having an axially elongated opening 20 therethrough to allow cord 13 to pass therethrough and to form turns easily along the entire axial length of the throat of the roller 11. Projection 19 may be internally threaded as at 21 to receive and hold one end of a flexible sheath 22 for the cord. The sheath 22 may be a plastics tube, or a close-lapped spring. The sheath 22 is locked in substantially vertical position on the window frame F by a clamping bracket 26 having resilient wings 27 between which the sheath 22 can be forced by hand. The bracket 26 is secured to one of the vertical posts of the window by screws 28. As the sheath is flexible, it permits the small movement of the sleeve 18 towards and away from the window frame.

The end portions 10 are rotatably mounted in elongated slots 24 of brackets 23, only one bracket being shown. The brackets are secured above the window. The lower edge portion of said slot 24 is denoted by reference 25.

Another end piece 6, similar to that shown but lacking the square portion 9, is attached to the other end of tube 2.

Mounting the positions 10 in the slots ensures the screen can always be close to and in contact with the window frame when said screen is in its operative, unrolled position. This considerably reduces heat losses, and the shading or shielding effect is increased. The portions 10 roll along the surfaces 25.

Figure 3:
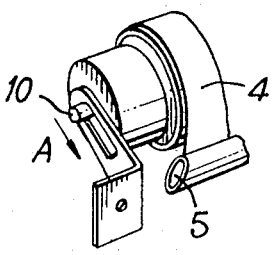
FIG. 3 is a perspective view showing the same parts as FIG. 2, but in a condition wherein the screen is rolled up.
Figure 4:
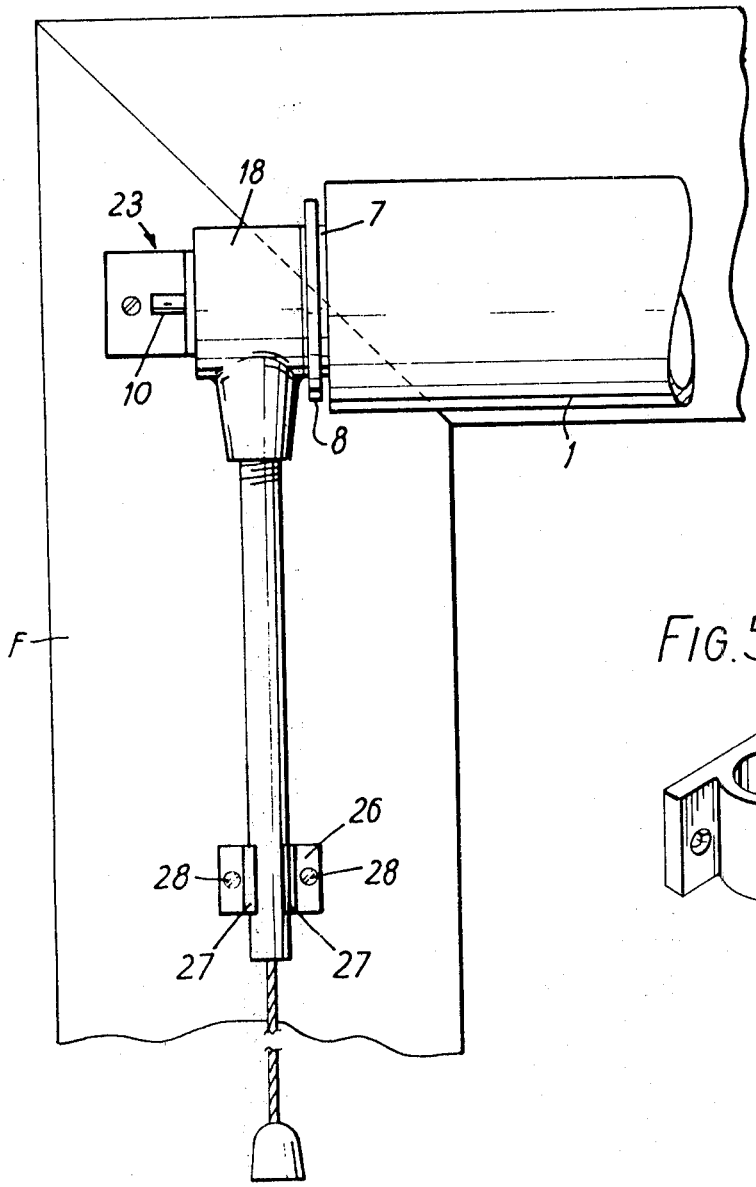
FIG. 4 is a partial front elevation of the roller blind, with the screen omitted, mounted on a window frame.
Figure 5:
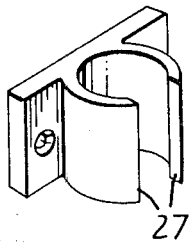
FIG. 5 is a perspective view of a retainer for the cord sheath.

If the screen is pulled downwards from the position of FIG. 3, the portions 10 rotate in clockwise direction in FIG. 3 and move in the direction of the arrow A in FIG. 3. The portions 10 move in the opposite direction B when the screen is wound up, as shown in FIG. 2.

It will be seen that the sleeve 18 is tubular and has both of its ends open, thereby permitting the end faces of the 11 to be permanently out of contact with the sleeve, that axial end face of the roller 11 which is remote from the roller 1 being arranged to abut slidably and rotatably against the adjacent inner face of the arm of the bracket containing the slot 24.

The roller 1, or rather the end piece 6 engaged therein, has its end flange 8 of a diameter which is greater than the inside diameter of the sleeve 18, whereby the sleeve 18 will abut the flange 18.

Figure 1:
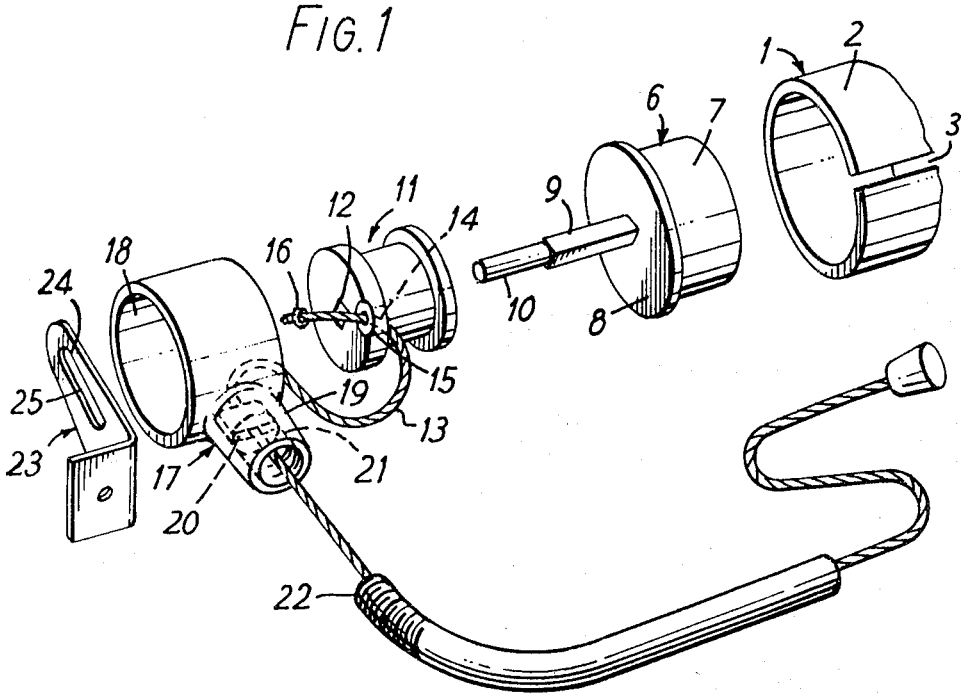
FIG. 1 is a perspective view of the preferred embodiment of the invention, the parts of the roller blind being shown in axially separated position for clarity of illustration.

This limits the axial movement of the sleeve 18 to the right in FIG. 1. The axial movement of the sleeve 18 to the left in FIG. 1 is limited by abutment of the sleeve 18 on the adjacent internal face of the arm of the bracket containing the slot 24. The bracket arm is arranged at such an axial spacing from the flange 8 that there is just sufficient axial end play for free relative rotaty movement of the flange 8 with respect to the sleeve 18.

The roller blind functions as follows:

Normally the blind is rolled down because the weight of the curtain rod 5 pulls down the screen and holds it stretched and in close contact with the vertical window frame.

When it is desired to roll up the screen, the cord 13 is pulled. This causes the flanged roller 11 and also tube 2 to rotate, thereby winding up the screen on tube 2. The wire may be locked in any desired position by securing the cord to a fixture (not shown) on the window frame.

I claim:

1. A roller blind comprising:

(i) a roller, to receive a screen, having a respective trunnion extending axially from each end of said roller, (ii) a screen having an end thereof secured to said roller, (iii) a pair of brackets for mounting on a support structure, each bracket including an arm with an elongated slot therein, the brackets each being such that when they are mounted on the supporting structure the slot extends in the direction towards and away from the supporting structure, the slot of each bracket arm receiving a respective one of the trunnions, (iv) a flanged pulley mounted on one of said trunnions and keyed for rotation therewith, (v) an open-ended sleeve disposed about and spaced radially from said pulley, said sleeve including a radial opening, (vi) a cord secured at one of its ends to said flanged pulley and passed through said radial opening of the sleeve, (vii) means for connecting said sleeve to the supporting structure such that the sleeve may not rotate about the axis of the trunnion but may travel towards and away from the supporting structure to the extent required by movement of the trunnions along their respective slots during winding and unwinding of the screen on the roller.

2. A roller blind, as claimed in claim 1, wherein said connecting means is a flexible sheath connected at one end to said sleeve and having means at its other end for connection to the supporting structure, said sheath communicating with said radial opening for passage of said cord.

3. A roller blind, as claimed in claim 2, wherein said sleeve includes a tubular radial projection the interior of which communicates with said opening, said sheath being engaged into said tubular projection.

4. A roller blind, as claimed in claim 1, wherein said radial opening of said sleeve is elongated, in the axial direction, to an extent to facilitate winding of turns of said cord side by side on said pulley.

5. A roller blind, as claimed in claim 1, wherein said roller has an end flange of greater diameter than the inside diameter of said sleeve, the axial spacing of said end flange from the adjacent bracket arm, when said flange abuts one axial end face of said pulley and when the other axial end face of said pulley abuts the bracket arm, being just greater than the axial length of said sleeve, whereby said flange remains freely rotatable with respect to said sleeve.

* * * * *